US009593621B2

(12) United States Patent
Quix et al.

(10) Patent No.: US 9,593,621 B2
(45) Date of Patent: *Mar. 14, 2017

(54) LUBRICATION SYSTEM FOR AN INTERNAL COMBUSTION ENGINE, AND METHOD FOR LUBRICATION

(71) Applicant: Ford Global Technologies, LLC, Dearborn, MI (US)

(72) Inventors: Hans Guenter Quix, Herzogenrath (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 97 days.

This patent is subject to a terminal disclaimer.

(21) Appl. No.: 14/512,337

(22) Filed: Oct. 10, 2014

(65) Prior Publication Data

US 2015/0027389 A1 Jan. 29, 2015

Related U.S. Application Data

(63) Continuation of application No. 13/413,408, filed on Mar. 6, 2012, now Pat. No. 8,857,403.

(30) Foreign Application Priority Data

Mar. 14, 2011 (DE) ..... 10 2011 005 496

(51) Int. Cl.
*F01M 5/02* (2006.01)
*F01P 7/16* (2006.01)
(Continued)

(52) U.S. Cl.
CPC ..... *F01P 7/16* (2013.01); *F01M 5/00* (2013.01); *F01M 5/021* (2013.01); *F01P 3/06* (2013.01); *F01P 2003/006* (2013.01)

(58) Field of Classification Search
CPC .. F02P 3/08; F01M 5/00; F01M 5/001; F01M 5/002; F01M 5/021
(Continued)

(56) References Cited

U.S. PATENT DOCUMENTS 3,453,995 A * 7/1969 Pekar, Jr. ..... F01M 1/02 123/196 R
5,018,490 A 5/1991 Kröner
(Continued)

FOREIGN PATENT DOCUMENTS

DE 2927680 A1 1/1981
DE 3344484 A1 6/1985
(Continued)

OTHER PUBLICATIONS

Partial Translation of Office Action of Chinese Application No. 2012100665716, Issued Jul. 27, 2015, State Intellectual Property Office of PRC, 9 Pages.

*Primary Examiner* — Marguerite McMahon
(74) *Attorney, Agent, or Firm* — Julia Voutyras; John D. Russell; B. Anna McCoy

(57) ABSTRACT

Embodiments for a lubrication system for an internal combustion engine are provided. In one example, a lubrication system for an internal combustion engine comprises a lubricant circuit, a radiator for cooling the lubricant, a heat accumulator arranged upstream of the engine for warming up the lubricant, the heat accumulator connected in parallel to the radiator, and a valve for switching over the lubricant circuit between the radiator and the heat accumulator. In this way, the oil may be rapidly heated during cold engine start conditions.

13 Claims, 2 Drawing Sheets

(51) Int. Cl.

| | |
|---|---|
| ***F01M 5/00*** | (2006.01) |
| ***F01P 3/06*** | (2006.01) |
| *F01P 3/00* | (2006.01) |

(58) Field of Classification Search
USPC ..... 123/196 AB, 41.56–41.58
See application file for complete search history.

(56) References Cited

U.S. PATENT DOCUMENTS

| | | | | |
|---|---|---|---|---|
| 6,536,381 | B2 | 3/2003 | Langervik | |
| 6,899,074 | B1 | 5/2005 | Carlsson | |
| 7,665,513 | B2 | 2/2010 | Sasaki | |
| 8,505,512 | B2 | 8/2013 | Neal et al. | |
| 2005/0039719 | A1* | 2/2005 | Moss | F01M 1/12<br>123/196 AB |
| 2009/0236435 | A1 | 9/2009 | Kudo et al. | |
| 2012/0048228 | A1* | 3/2012 | Chung | F01M 1/08<br>123/196 R |

FOREIGN PATENT DOCUMENTS

| | | | |
|---|---|---|---|
| DE | 10300411 | A1 | 7/2004 |
| DE | 102005052632 | A1 | 5/2007 |
| EP | 2103789 | A1 | 3/2009 |

* cited by examiner

LUBRICATION SYSTEM FOR AN INTERNAL COMBUSTION ENGINE, AND METHOD FOR LUBRICATION

CROSS REFERENCE TO RELATED APPLICATIONS

The present application is a continuation of U.S. patent application Ser. No. 13/413,408, entitled "LUBRICATION SYSTEM FOR AN INTERNAL COMBUSTION ENGINE, AND METHOD FOR LUBRICATION," filed Mar. 6, 2012, which claims priority to German Patent Application No. 102011005496.0, filed on Mar. 14, 2011, the entire contents of each of which are hereby incorporated by reference for all purposes.

FIELD

The disclosure relates to a lubrication system for an internal combustion engine, and to a method for lubricating the internal combustion engine.

BACKGROUND AND SUMMARY

Typical internal combustion engines of this type are highly efficient, which leads to an impairment in the warming up of the engine. Cold engine oil causes a rise in the fuel consumption on account of the increased inner friction of the engine. Numerous methods are exploited, in order to warm up the engine oil more rapidly. A customary approach is the use of a chemical heat accumulator. On account of the low heating performance of an appropriate chemical heat accumulator which lies in the range of 2-3 kW, some minutes are required to transfer the completely available heat to the engine. The time for the transfer of the thermal energy has to be as short as possible, in order to achieve significant advantages in saving fuel directly after a cold start of the engine. Furthermore, a coolant circuit through the engine is necessary, in order to transfer the energy of the heat accumulator to the engine.

DE 33 44 484 A1, DE 29 27 680 A1, and EP 2 103 789 A1 disclose systems for warming up an engine and having a heat accumulator and an additional circuit for a coolant.

DE 10 2005 052 632 A1 discloses an apparatus for warming up an engine with an oil heat accumulator. High temperature oil is stored in the oil heat accumulator during operation of the engine. The oil heat accumulator is highly insulated, with the result that the oil can keep its temperature substantially even over a relatively long time period. In the case of a cold start of the engine, the high temperature oil from the oil heat accumulator is first used to lubricate and heat the engine. However, the use of the oil heat accumulator requires high structural outlay, reducing engine efficiency.

The inventors herein have recognized the issues with the above approach and have developed a system to at least partly address them. According to an embodiment of the disclosure, a lubrication system for an internal combustion engine comprises a lubricant circuit, a radiator for cooling the lubricant, a heat accumulator arranged upstream of the engine for warming up the lubricant, the heat accumulator connected in parallel to the radiator, and a valve for switching over the lubricant circuit between the radiator and the heat accumulator.

According to the disclosure, the heating up takes place directly in the lubricant circuit; no additional coolant circuit is required. Therefore, what is known as a "no flow strategy" can be realized, which makes further scope for saving fuel possible. The lubricant is heated up directly and in a targeted manner, with the result that the engine runs with low friction and therefore with low consumption even after a cold start. The connection in parallel of the radiator and the heat accumulator with the valve for switching over is structurally simple and efficient during operation. The lubrication system according to the disclosure can also be retrofitted in existing engines as a result of the simple construction of the lubrication system and the fact that merely a valve and a heat accumulator are required.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure

DETAILED DESCRIPTION

Figure 1:
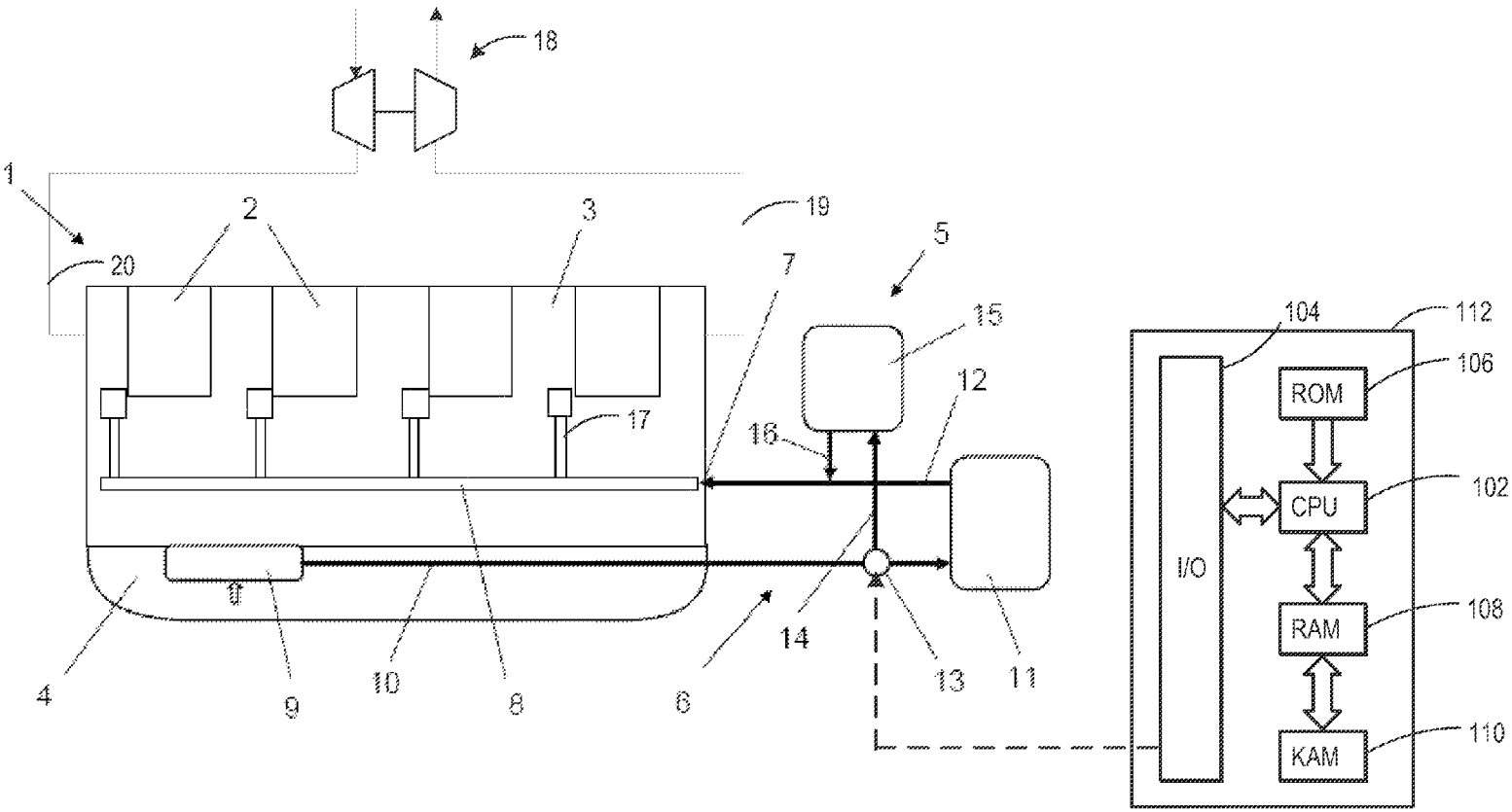
FIG. 1 shows a block circuit diagram of an engine with a lubrication system according to the disclosure.

The present disclosure provides for an engine lubrication circuit in which, during conditions of cold engine temperature, the lubricant is routed through a heat accumulator in order to heat the lubricant, and thus the engine. Once the lubricant and/or engine have reached a threshold temperature, the lubricant is routed through a radiator in order to prevent overheating of the lubricant and engine. In this way, the lubricant may be rapidly heated to improve fuel economy during cold start conditions.

The lubricant may be oil. On account of the low thermal capacity of the oil in comparison with a coolant, a higher temperature rise of the oil in comparison with the coolant can be achieved with the same discharging performance. The temperature increase of the oil leads to a considerable reduction of the friction within the engine.

A pump may be arranged in the lubricant circuit for delivering the lubricant. The lubricant can be delivered through the lubricant circuit by means of a pump, which improves the temperature behavior of the oil and the engine.

The heat accumulator may be a chemical heat accumulator. A chemical heat accumulator is low maintenance and, in the case of a sensible heat accumulator capacity, has satisfactory performance during the output and input of heat.

The lubricant circuit may run through or past the radiator in a normal mode and through or past the heat accumulator in a warming up mode. In a normal mode, that is to say when the oil and/or the engine have reached its operating temperature and/or when the heat accumulator has output its available energy to the oil, the oil is cooled by the radiator. In a warming up mode, for example after a cold start or when the oil and/or the engine have not yet reached its operating temperature, the oil is warmed up by the heat accumulator.

The heat accumulator may be arranged on the lubricant circuit in such a way that the heat accumulator is charged by the lubricant in the normal mode. After the engine has reached its operating temperature, the heat accumulator can be charged by the lubricant, in order for it to be possible to output heat again in the case of a repeated cold start. The charging of the heat accumulator is more efficient on account of the higher temperature of the oil in comparison with a coolant.

The cooling performance of the radiator may be substantially equal to the charging capacity for the heat accumulator. As a result, the oil temperature is not influenced by the charging of the heat accumulator during a warm operating state.

The heat accumulator may be arranged directly upstream of the engine. It is therefore also guaranteed for lubricant with a low thermal capacity such as oil that heated lubricant enters the engine, with the result that the friction in the engine is reduced even after a cold start.

According to an embodiment of the disclosure, an internal combustion engine comprises a lubrication system as described above. The internal combustion engine has the same advantages and refinements as described for the lubrication system.

According to a further embodiment of the disclosure, a method for lubricating an internal combustion engine with a lubricant circuit comprises circulation of the lubricant along a heat accumulator in a warming up mode; switchover of the lubricant circuit into a normal mode; and circulation of the lubricant along a radiator which is connected in parallel to the heat accumulator, in the normal mode.

According to the disclosure, in a warming up mode, in which the lubricant and/or the engine has not yet reached its operating temperature (such as after a cold start), the radiator is bridged as it were and the lubricant is circulated through or along a heat accumulator, with the result that the oil is warmed up directly and rapidly. The friction within the engine can thus be reduced in a simple way even directly after a cold start.

The heat accumulator can be charged in the normal mode. After the engine has reached its operating temperature, the heat accumulator can be charged by the lubricant, in order for it to be possible to output heat again in the case of a repeated cold start. This allows an efficient overall system.

A switchover into the normal mode can be carried out when the heat accumulator has output the available energy and/or when the lubricant and/or the engine have reached its operating temperature. When one or both conditions are met, an efficient warming up mode is ended and a switchover takes place into the normal mode which is then more efficient.

FIG. 1 shows a diagrammatically illustrated internal combustion engine 1 with four cylinders 2 which are arranged in an engine block 3. An oil sump 4 is situated below the engine 3.

A lubrication system 5 has a lubricant circuit 6, through which a lubricant circulates, in this case oil. The oil enters the engine 1 at an inlet point 7, where it is moved to the cylinders 2 by means of a main oil gallery 8. In one embodiment, the oil may pass from the oil gallery 8 to one or more piston cooling jets 17, which may be activated by a control or check valve to provide oil to the underside of a piston in order to cool the piston. Thereupon being provided to the cylinders, the oil passes through the engine 1 into the oil sump 4. An oil pump 9 conveys the oil through a line 10 which leaves the engine 1. The line 10 leads to a radiator 11, in which the oil is cooled. The oil circulates back in the direction of the engine 1 via a further line 12 which is connected to the inlet point 7.

A valve 13 is arranged in the line 10 upstream of the radiator 11. A branch line 14 which leads to a heat accumulator 15 branches off from the valve 13. The heat accumulator 15 is, for example, a chemical heat accumulator with a heating performance of, for example, 2-3 kW. A discharging line 16 of the heat accumulator 15 is connected to the line 12. The heat accumulator 15 is arranged in the immediate vicinity of the engine 1. In particular, the discharging line 16 is situated in the immediate vicinity of the inlet point 7. It is also possible that the discharging line 16 leads directly to the inlet point 7, that is to say the discharging line 16 and the line 12 enter the engine 1 in parallel, as it were.

The heat accumulator 15 is connected in parallel to the radiator 11, the valve 13 controlling whether the lubricant circuit 6 runs through the radiator 11 or through the heat accumulator 15.

The lubrication system 5 comprises the radiator 11, the heat accumulator 15, the valve 13 and the lubricant circuit 6. The lubricant circuit 6 can be assigned the components which are external with respect to the engine 1, such as at least part of the line 10, the further line 12, the branch line 14 and the discharging line 16. It is also possible to define the lubricant circuit 6 in such a way that components which are internal with respect to the engine, such as the main oil gallery 8, the oil sump 4 and the oil pump 9, are also constituent parts of the lubricant circuit 6. Furthermore, the lubrication system 5 can be a constituent part of the engine 1.

The mode of operation of the lubrication system 5 will now be explained. After a cold start of the engine 1, that is to say when the oil and/or the engine 1 are cold, that is to say below the operating temperature, and the heat accumulator is charged with energy, the valve 13 switches the circulation of the oil over to the heat accumulator 15. The oil cooler 11 is bridged in this warming up mode. The control of the valve 13 can be assumed, for example, by the controller 112 of the engine 1.

The cold oil circulates through the heat accumulator 15 or along the heat accumulator 15, which can be a result of the design of the heat accumulator 15. The oil which is then warmed up leaves the heat accumulator 15 via the discharging line 16 and enters the engine 1. In the engine 1, it passes via the main oil gallery 8 to the cylinders 2 which are lubricated by the oil.

On account of the low thermal capacity of the oil in comparison with a coolant and the arrangement of the heat accumulator 15 directly on the engine 1 or, in other words, directly in front of the main oil gallery 8, the oil enters the engine 1 at a considerably increased temperature, which leads to a considerable reduction in the friction. By way of this configuration, the cold oil can be warmed up by, for example, approximately 25° C.

The expression "directly on the engine" can be defined in such a way that the path from the heat accumulator 15 to the inlet point 7 or to the main oil gallery 8 is so short that the warmed up oil which emerges from the heat accumulator 15 is not cooled or is cooled only insubstantially. The actual spatial arrangement of the heat accumulator 15 can be correspondingly further away if the discharging line 16 and/or at least part of the line 12 is insulated, in order to reduce or to prevent the heat loss of the oil.

The oil which runs through the engine 1 is collected in the oil sump 4 and is conveyed from there out of the engine 1 again by the oil pump 9. At the valve 13, the oil is again circulated through the heat accumulator 15 back to the engine 1. This warming up mode lasts until the oil and/or the engine 1 has reached its operating temperature and/or the heat accumulator 15 has output its available energy.

A transition is then made into the normal mode. To this end, the valve 13 switches the lubricant circuit 6 to the oil cooler 11. The oil which has reached its operating temperature is then cooled by the radiator 11, in order thus to prevent overheating of the oil and the engine 1.

During the normal mode, the heat accumulator 15 which is emptied by the cold start is recharged by the oil which is now heated up. This can take place in several ways. Firstly, the valve 13 can be moved into the position for the warming up mode again, with the result that the warm oil circulates through the heat accumulator 15 and in the process charges the latter. After the heat accumulator 15 is completely charged, the coolant circuit 6 is switched over to the radiator 11 again by means of the valve 13. During the charging of the heat accumulator 15, it assumes the function of the oil cooler 11 by cooling the oil.

It is also possible that the valve 13 assumes a position, in which part of the oil circulates through the radiator 11 while another part of the oil circulates through the heat accumulator 15. The line 12 or a part of the line 12 can also lead past the heat accumulator 15 or through it, in such a way that the heated up oil outputs heat to the heat accumulator 15, in order to charge it. Ideally, the charging capacity of the heat accumulator is designed in such a way that it corresponds to the cooling performance of the oil cooler. In this way, the switchover of the lubricant circuit with the valve 13 would have no effect on the oil temperature of the engine.

After the heat accumulator 15 is charged, the lubrication system 5 remains in the normal mode. The time period for charging of the heat accumulator 15 is a special case of the normal mode, in which the valve 13 can assume the position of the warming up mode in some circumstances.

After the engine 1 has been switched off and has been started again, the temperature of the oil is measured, in order to decide whether the lubrication system 5 can start directly in the normal mode. This is the case if the oil and/or the engine still have its operating temperature or a temperature above it. If the oil and/or the engine 1 has a temperature below an operating temperature or another defined temperature threshold and the heat accumulator is charged with available energy, the lubrication system 5 is set into the warming up mode.

In some embodiments, the valve 13 may be a three-way valve. As such, it may have a first position wherein oil is directed through the heat accumulator 15 before reaching the engine 1, and it may have a second position wherein oil is directed through the radiator 11 before reaching the engine 1. The valve 13 may have a third position wherein the oil is directed from the pump 9 to the engine 1 without passing through the radiator 11 or the accumulator 15. Thus, in the third position, the oil may be blocked from reaching both the radiator 11 and the heat accumulator 15. The valve 13 may be controlled into the third position based on various engine operating parameters. For example, if the heat accumulator is not charged with heat and the engine is in cold start conditions, the oil may be directly routed to the engine to expedite engine warm-up. The temperature of the heat accumulator may be determined by a sensor within the accumulator, for example.

Controller 112 is shown in FIG. 1 as a conventional microcomputer including: microprocessor unit 102, input/output ports 104, read-only memory 106, random access memory 108, keep alive memory 110, and a conventional data bus. Controller 112 may include instructions that are executable to carry out one or more control routines. Controller 112 is shown receiving various signals from sensors coupled to engine 1, such as input from one or more temperature sensors (e.g., engine temperature, oil temperature), as well as other sensors not shown in FIG. 1 (for example, a sensor indicating the charging capacity of the heat accumulator 15, and/or a knock sensor which may indicate knocking of one or more cylinders of the engine 1). Example sensors include engine coolant temperature (ECT) from a temperature sensor, a position sensor coupled to an accelerator pedal for sensing accelerator position, a measurement of engine manifold pressure (MAP) from a pressure sensor coupled to an intake manifold of the engine, an engine position sensor from a Hall effect sensor sensing crankshaft position, a measurement of air mass entering the engine from a sensor (e.g., a hot wire air flow meter), and a measurement of throttle position. Barometric pressure may also be sensed for processing by controller 112. In a preferred aspect of the present description, an engine position sensor may produce a predetermined number of equally spaced pulses every revolution of the crankshaft from which engine speed (RPM) can be determined Controller 112 may also output signals to various actuators of the engine, such as valve 13.

Also shown in FIG. 1 is a turbocharger 18. The turbocharger 18 may have a turbine which is coupled to an exhaust passage 19 of the engine. The exhaust from the exhaust passage may expand within the turbine, causing it to rotate. The turbine is coupled to a compressor of the turbocharger 18 via a shaft, and thus the compressor rotates and acts to compress intake air, which is passed to the engine via an intake passage 20. In this way, compressed air may be provided to the cylinders to boost the engine and increase power output.

Figure 2:
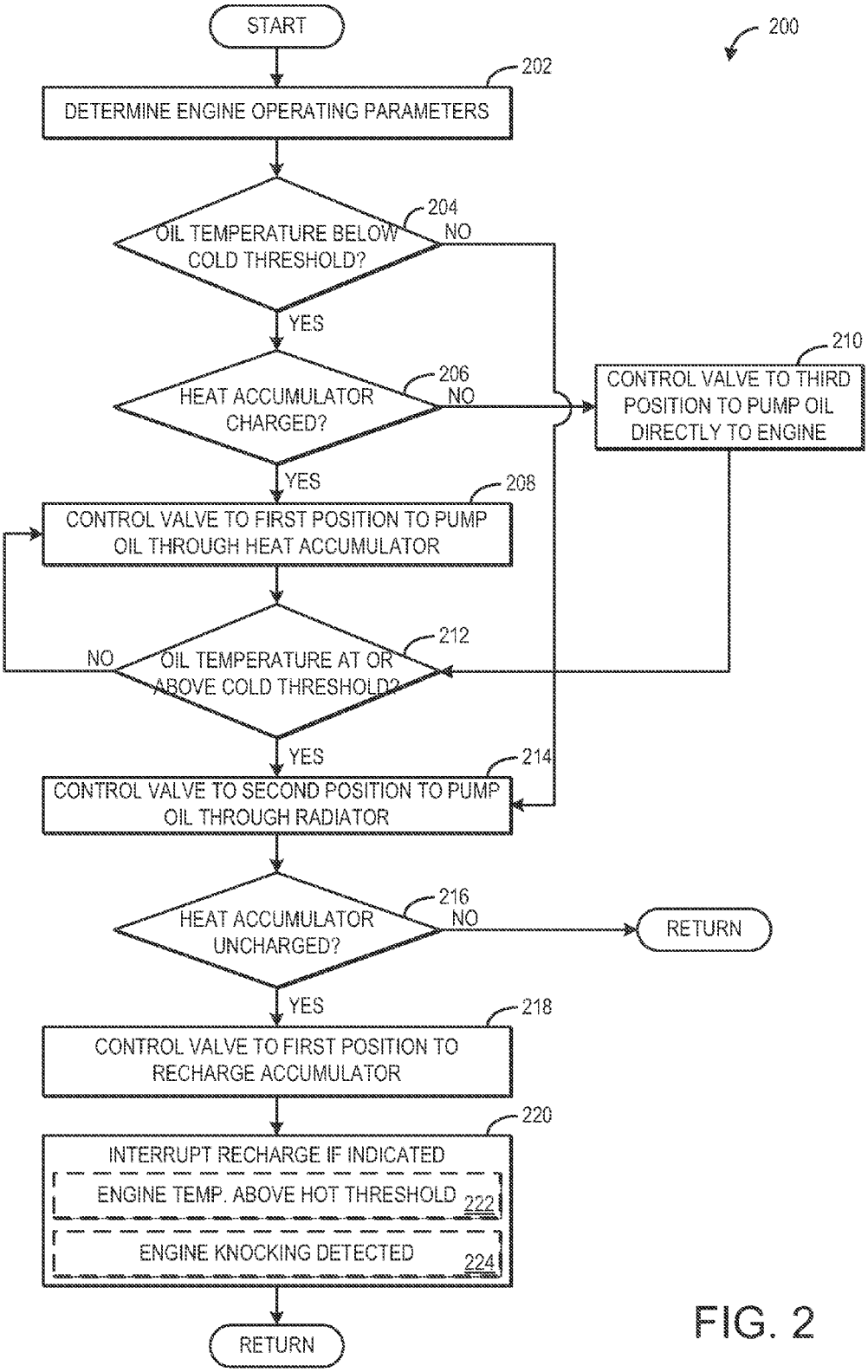
FIG. 2 is a flow chart illustrating a method for controlling oil temperature according to an embodiment of the present disclosure.

FIG. 2 is a flow chart illustrating a method 200 for controlling oil temperature according to an embodiment of the present disclosure. Method 200 may be carried out according to instructions stored in the memory of controller 112. At 202, method 200 includes determining engine operating parameters. Engine operating parameters may include engine oil temperature, engine temperature, whether the engine is cranking, engine speed, etc. At 204, method 200 includes determining if engine oil temperature is below a cold threshold. The cold threshold may be a suitable threshold below which the oil has an increased viscosity that contributes to reduced fuel economy, such as warmed up engine temperature. The oil temperature may be determined by a sensor in the engine oil system, or it may be determined by engine temperature, whether the engine is in cold start conditions, etc.

If it is determined the engine oil temperature is not below the cold threshold (e.g., the answer at 204 is no), method 200 proceeds to 214, which will be described in more detail below. If the engine oil temperature is below the cold threshold, method 200 proceeds to 206 to determine if the heat accumulator is charged. The heat accumulator, such as accumulator 15, may be charged with heat from heated engine oil, from a previous engine operation for example. However, if the engine has been turned off for a threshold time, such as one day, two days, etc., the heat accumulator may begin to cool down and thus not be able to supply the oil with the heat for heating the engine. This may be determined by a temperature of the heat accumulator, based a time since a previous recharging of the heat accumulator, etc.

If it is determined that the heat accumulator is charged, method 200 proceeds to 208 to control a valve to a first position to pump oil to the engine via the heat accumulator. The valve may be the valve 13 that routes oil to the heat accumulator 15 in a first position and routes the oil to the radiator 11 in a second position. With the valve in the first position, the oil that is pumped from the sump will be directed to the heat accumulator before reaching the engine. As such, the heat that is stored in the accumulator may be transferred to the oil to warm the oil. However, if it is determined that the heat accumulator is not charged with heat, method 200 proceeds to 210 to control the valve to a third position to pump oil directly to the engine without the oil traveling through the accumulator or radiator. In this way, the oil can be heated by the engine rapidly.

Both 208 and 210 proceed to 212, where it is determined if the oil is at or above the cold threshold. If the oil is not at or above the cold threshold, that is if the oil is still below the cold threshold, method 200 returns to 208 to continue to pump oil to the engine via the accumulator. If the oil has reached the threshold, additional heating of the oil is not indicated. Thus, at 214, the valve is controlled to the second position to pump oil through the radiator. In this way, the oil may be cooled to prevent overheating of the oil and the engine. At 216, it is determined if the heat accumulator is uncharged. If the oil was pumped through the accumulator, it may have depleted the stored heat, causing the accumulator to be below a charge threshold, and thus heated oil may be routed back through the accumulator to charge it with heat. If the accumulator is not uncharged, that is, if it is charged with a sufficient amount of heat, method 200 returns. If the accumulator is uncharged, the valve is controlled back to the first position in order to recharge the heat accumulator at 218. If it is determined the heat accumulator is not charged with sufficient heat, it may be heated by the warmed engine oil when the valve is set at the first position. This may be performed if the temperature of the heat accumulator drops below a threshold, or if the heat accumulator was recently used to warm the oil (such as during a cold engine start).

At 220, the recharge of the accumulator may be interrupted if indicated. The recharge may be interrupted based on various operating conditions. For example, at 222, if the engine temperature is greater than a hot threshold, the heat accumulator may not sufficiently cool the oil compared to the radiator, and thus the oil may be pumped through the radiator instead. The hot threshold may be a threshold greater than the cold threshold. The hot threshold may be a temperature above which engine damage may occur. The cooled oil may be pumped from the radiator to the piston cooling jets of the engine, for example, in order to cool the cylinders.

In another example, at 224, the recharge may be interrupted is engine knocking is detected. Engine knocking may be detected by one or more knocking sensors of the engine. If knocking is detected, the engine may need to be cooled to cease the knocking. If the oil is being directed to the accumulator prior to reaching the engine, it may not be cooled enough to prevent knocking. As such, the recharging may be interrupted so that the oil can be cooled via the radiator. In some embodiments, the recharging of the heat accumulator may be interrupted based on whether or not the engine is boosted. For example, if boost pressure exceeds a threshold, the recharging may be interrupted to enable sufficient cooling of the engine. Method 200 then returns.

Thus, method 200 of FIG. 2 provides for an engine method comprising during a first condition, pumping oil to piston cooling jets of the engine through a heat accumulator; during a second condition, pumping oil to the piston cooling jets through a radiator, bypassing the heat accumulator, and periodically recharging the heat accumulator by pumping engine oil through the heat accumulator; and in response to operating conditions, interrupting the recharge.

The method includes wherein the first condition comprises oil temperature below a threshold, and wherein the second condition comprises oil temperature at or above the threshold. The method also includes wherein interrupting the recharge further comprises pumping oil to the piston cooling jets through the radiator, bypassing the heat accumulator. The method includes wherein the operating conditions comprise engine temperature above a hot threshold. The method also includes wherein the operating conditions comprise engine knocking. The method also includes during a third condition, pumping oil directly to the piston cooling jets, and wherein the third condition comprises the heat accumulator being below a charge threshold.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A lubrication system for an internal combustion engine, comprising:

an oil lubricant circuit;

a radiator for cooling a lubricant;

a piston cooling jet coupled in the oil lubricant circuit;

a chemical heat accumulator arranged upstream of the engine for warming up the lubricant, the heat accumulator connected in parallel to the radiator;

a valve for switching over the lubricant circuit between the radiator and the heat accumulator; and a controller with computer-readable instructions stored in non-transitory memory for:

operating the lubrication system in a first mode when a lubricant temperature is below a threshold;

operating the lubrication system in a second mode when the lubricant temperature is above the threshold; and charging the chemical heat accumulator during the second mode.

2. The lubrication system as claimed in claim 1, wherein the engine is a turbocharged engine; wherein in the first mode, the valve is actuated to a first position to deliver the lubricant from a pump to the heat accumulator; and wherein in the second mode, the valve is actuated to a second position to deliver the lubricant from the pump to the radiator.

3. The lubrication system as claimed in claim 2, further comprising a pump arranged in the lubricant circuit for delivering the lubricant; and wherein in the first mode, responsive to the heat accumulator not being charged, the valve is actuated to a third position to deliver the lubricant from the pump directly to the engine without passing through the radiator or the accumulator.

4. The lubrication system as claimed in claim 2, wherein oil passes from an oil gallery to the piston cooling jet; and wherein in the second mode, responsive to the heat accumulator not being charged, the valve is actuated to the first position to deliver the lubricant from the pump to the heat accumulator to charge the heat accumulator.

5. The lubrication system as claimed in claim 4, wherein during the charging, the valve is maintained in the first position until the heat accumulator is charged, whereupon the valve is returned to the second position.

6. The lubrication system as claimed in claim 5, wherein the heat accumulator is arranged on the lubricant circuit in such a way that the heat accumulator is charged by the lubricant in the second mode; and wherein during the charging, the valve is returned to the second position in response to the lubricant temperature exceeding a second threshold.

7. The lubrication system as claimed in claim 5, wherein cooling performance of the radiator is substantially equal to charging capacity for the heat accumulator; and wherein during the charging, the valve is returned to the second position in response to engine knocking.

8. The lubrication system as claimed in claim 1, wherein the heat accumulator is arranged directly upstream of the engine.

9. An internal combustion engine having the lubrication system as claimed in claim 1.

10. A method for lubricating an internal combustion engine with a lubricant circuit, comprising:

circulating a lubricant along a chemical heat accumulator in a warming up mode with a valve in a first position;

switching over to the lubricant circuit into a normal mode by actuating the valve to a second position;

circulating the lubricant along a radiator which is connected in parallel to the heat accumulator in the normal mode with the valve in the second position;

during the warming up mode, actuating the valve to a third position in response to the chemical heat accumulator being discharged, where the third position delivers the lubricant from a pump directly to the engine without passing through the radiator or the chemical heat accumulator;

recharging the heat accumulator during the normal mode in response to the heat accumulator not being charged; and delivering the lubricant to a piston cooling jet of the engine.

11. The method as claimed in claim 10, wherein recharging the heat accumulator includes actuating the valve to the first position and circulating lubricant through the chemical heat accumulator until the chemical heat accumulator is charged, whereupon the valve is returned to the second position.

12. The method as claimed in claim 11, wherein the switching over into the normal mode is carried out when the heat accumulator has output available energy; and wherein during the charging, the valve is maintained in the first position until the heat accumulator is charged, whereupon the valve is returned to the second position.

13. The method as claimed in claim 10, wherein the switching over into the normal mode is carried out when the lubricant has reached an operating temperature; and wherein during the charging, the valve is returned to the second position in response to engine knocking.

* * * * *